US007429191B2

(12) United States Patent
Diaz et al.

(10) Patent No.: US 7,429,191 B2
(45) Date of Patent: Sep. 30, 2008

(54) COVER PLATE FOR A PERSONAL COMPUTER REAR PANEL

(75) Inventors: Elizabeth Brandon Swan Diaz, Woodside, CA (US); Amear A. Karim, San Jose, CA (US); Karl R. Hassur, San Jose, CA (US); Michael C. Ip, Fremont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 194 days.

(21) Appl. No.: 11/025,539

(22) Filed: Dec. 28, 2004

(65) Prior Publication Data

US 2006/0141830 A1 Jun. 29, 2006

(51) Int. Cl.
*H01R 13/60* (2006.01)

(52) U.S. Cl. ..... 439/540.1

(58) Field of Classification Search ..... 439/101, 439/488–491, 638, 61, 76.1, 540.1, 564, 439/573, 550–555; 361/788, 683, 686, 785
See application file for complete search history.

(56) References Cited

U.S. PATENT DOCUMENTS

| | | | | |
|---|---|---|---|---|
| 5,545,057 | A * | 8/1996 | Tan et al. | 439/540.1 |
| 6,139,356 | A * | 10/2000 | Daoud | 439/491 |
| 6,347,963 | B1 * | 2/2002 | Falkenberg et al. | 439/638 |
| 6,375,495 | B1 * | 4/2002 | Szeto | 439/540.1 |
| 6,608,764 | B2 * | 8/2003 | Clark et al. | 361/796 |
| 6,718,674 | B2 * | 4/2004 | Caveney et al. | 40/642.02 |
| 6,761,583 | B2 * | 7/2004 | Ortowski et al. | 439/540.1 |

* cited by examiner

*Primary Examiner*—Edwin A. León

(57) ABSTRACT

A cover plate for a rear panel of a personal computer (PC) is disclosed. The cover plate has openings for connectors and ports found on the rear panel of the PC. Another portion of the cover plate conceals a portion of the rear panel from view. The portion of the cover plate that conceals the rear panel of the PC has text-labels identifying the openings in the cover plate. The cover plate is removably coupled with the rear panel of the PC.

19 Claims, 3 Drawing Sheets

COVER PLATE FOR A PERSONAL COMPUTER REAR PANEL

FIELD OF THE INVENTION

Embodiments of the present invention relate to personal computers.

BACKGROUND OF THE INVENTION

The personal computer (PC) is becoming a standard household convenience. Digital devices such as digital cameras, camcorders, compact disc (CD) players, digital video disc (DVD) players, satellite radio receivers, etc., are fast replacing their analog counterparts. Currently, digital entertainment PCs are commercially available. Using an entertainment PC, a user can store multiple forms of digital media such as photos, music, and video, and choose to access such media through such devices as a PC monitor, through a television or through home stereo equipment. Users can play PC games and surf the Internet using their television monitors, or store recorded TV shows on their PC. Entertainment PCs are a way for a user to combine all the capabilities of a PC with multiple means of enjoying digital media.

One drawback of an entertainment PC is that the rear panel of the PC is unfamiliar to many consumers. For many consumers unfamiliar with computers, the thought of navigating the metal tabs and fans and connectors, etc., found on a typical PC rear panel is intimidating.

SUMMARY OF THE INVENTION

Embodiments of the present invention pertain to a cover plate for the rear panel of a personal computer (PC). In one embodiment, the cover plate conceals most of the rear panel of the PC, and has labels identifying each opening.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Reference will now be made in detail to various embodiments of the invention, examples of which are illustrated in the accompanying drawings. While the invention will be described in conjunction with various embodiments, it will be understood that they are not intended to limit the invention to these embodiments. On the contrary, the invention is intended to cover alternatives, modifications and equivalents, which may be included within the spirit and the scope of the invention as defined by the appended claims. Furthermore, in the following detailed description of the present invention, numerous specific details are set forth in order to provide a thorough understanding of the present invention. However, it will be apparent to one skilled in the art that the present invention may be practiced without these specific details. In other instances, well-known components, structures and devices have not been described in detail so as to avoid unnecessarily obscuring aspects of the present invention.

Figure 1:
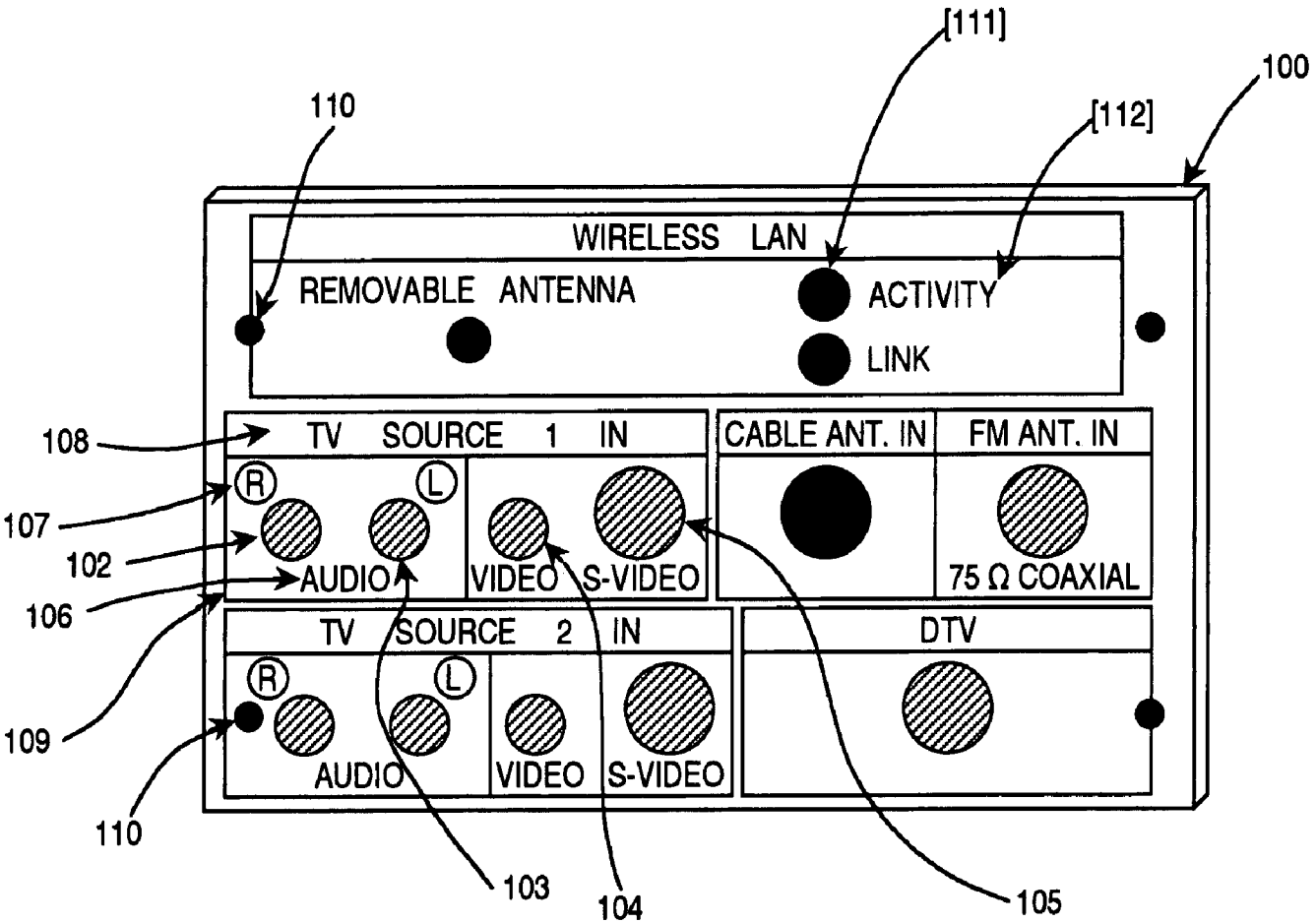
FIG. 1 is a depiction of a cover plate for a rear panel of a personal computer (PC), according to one embodiment of the present invention.

FIG. 1 is an illustration of a cover plate [100] for the rear panel of a personal computer (PC), in accordance with an embodiment of the present invention. The cover plate can be manufactured from any material that is safe for mounting in proximity to the rear panel of a PC. The cover plate can be any thickness that allows for necessary access to the rear panel of the PC. In one embodiment, the cover plate is opaque. Alternatively, the cover plate for a rear panel of a PC could be transparent or partially transparent. In one embodiment, the cover plate is a thin piece of metal. In another embodiment, the cover plate is a piece of plastic.

In one embodiment, the cover plate [100] has dimensions approximately the same as a PC rear panel. In another embodiment, a plurality of cover plates [100] of various dimensions are used to cover the rear panel of the PC.

The cover plate [100], in one embodiment of the present invention, has openings [102] to permit access to connectors located on the rear panel of the PC. The openings on the cover plate can have circular, square, rectangular, or irregular shapes, depending, for example, on the shapes of the connectors on the rear panel of the PC. The openings [102] on the cover plate [100] are arranged according to the arrangement of connectors on the PC rear panel. Typical connectors found on the rear panel of a PC include a power source input, Internet ports and Ethernet ports. Connectors found on digital entertainment PC rear panels include television input, video output, audio output, infrared transmitter output as well as those found on typical PC rear panels, in addition to those mentioned above.

A Peripheral Component Interconnect (PCI) card is one way to connect an external device with a personal computer. A PCI card typically consists of at least one printed circuit board and at least one connector. For example, a PCI card may be used to receive television signals. A PCI card designed for this purpose may have a left audio input connector, a right audio input connector and a video input connector. Connectors are built into the PCI card and situated so that when the PCI card is inserted into an open slot in the back of the PC, the connectors are exposed and the PC user can insert the appropriate cables, etc. The addition of a new PCI card may require a new cover plate [100] for a portion of the rear panel. Cover plates in accordance with embodiments of the present invention are removably connected to the rear panel of the PC, and the cover plates can be replaced as needed.

For an entertainment PC with a rear panel cover plate in accordance with an embodiment of the present invention, specialized PCI cards may be used. An example of a specialized PCI card is a PCI card with a printed circuit board (PCB) and connectors devoted to a single device, e.g., a high definition television, that can be connected with the entertainment PC. Another example of a specialized PCI card is a PCI card having a POB and connectors devoted to a single function of the entertainment PC, e.g., audio output. The connectors for such a specialized PCI card can be quickly and easily utilized by a PC user when a cover plate, in accordance with embodiments of the present invention, is installed on a region of the rear panel of the entertainment PC containing the specialized PCI card.

Figure 2:
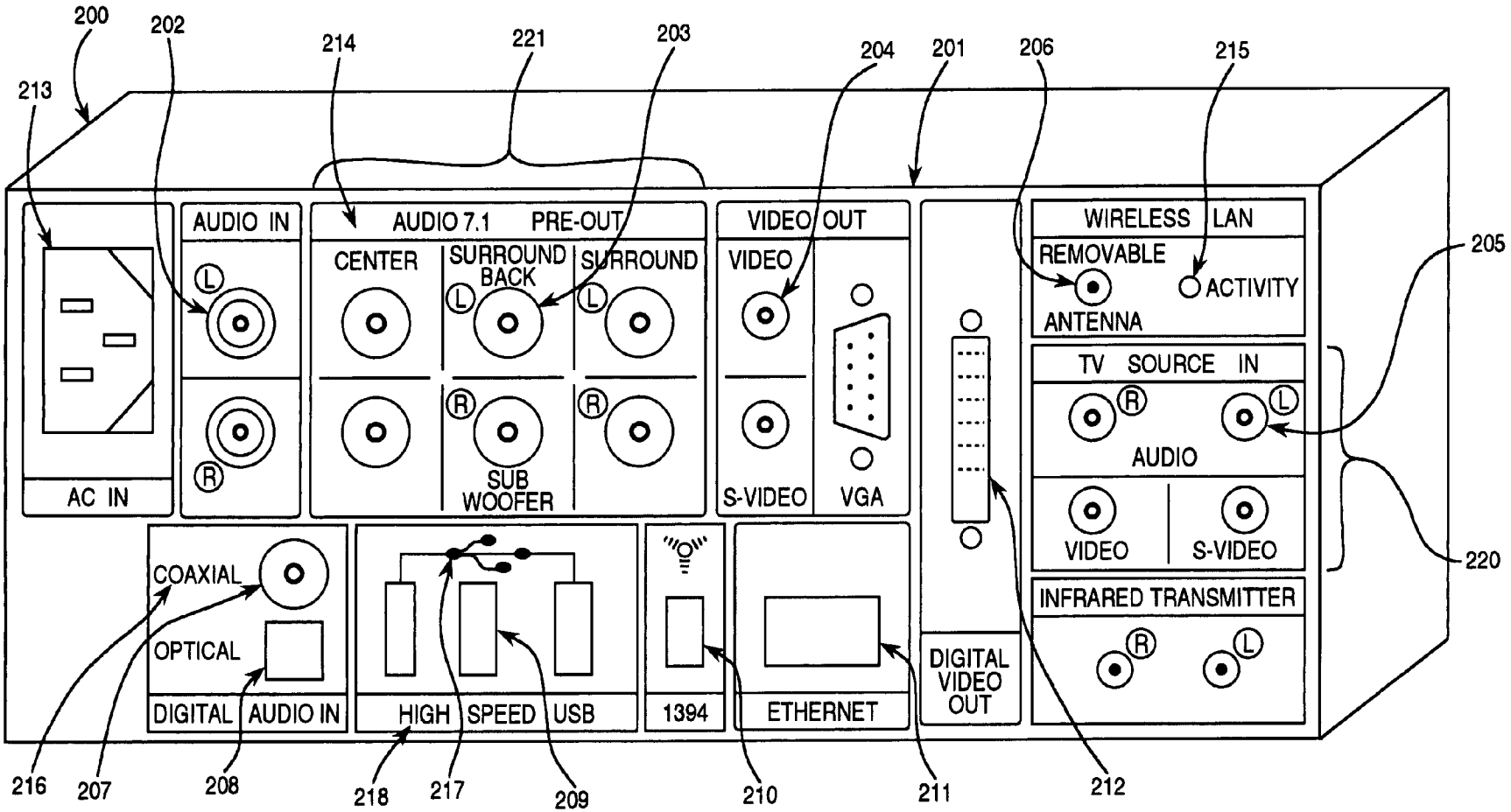
FIG. 2 is an illustration of personal computer with a cover plate mounted on the rear panel, according to one embodiment of the present invention.

In one embodiment of the present invention, PCBs within PCI cards are used with the rear panel cover plate. The custom PCBs include specially designed input and output groupings for optimized customer installation processes. For example, output connections are located on the left hand side of the rear panel and input connections are situated on the right hand side of the rear panel. Within the output connections, audio connections are grouped together, as well as video connections. In accordance with an embodiment of the present invention, these connections are labeled on the rear panel cover plate [201], as depicted in FIG. 2.

The cover plate [100] of the present invention, depicted in FIG. 1, has openings [102] for connectors which are accessed from the rear panel of the PC. For example, a cover plate for a region of the rear panel of a PC that includes an alternating current (AC) input connector has an opening for that connector. As another example, a cover plate [100] for the region of the rear panel of the PC where a television input card is located has an opening for a right audio input [102], a left audio input [103], a video input [104], and an s-video input [105].

Each opening [102] has a corresponding label [107] on the cover plate indicating the purpose of the opening [102], e.g., "R" for a right audio input connector. In one embodiment, groupings of openings for connectors pertaining to one device or function have an extra, more general label [106]. For example, in one embodiment, a pair of openings [102 and 103] for left and right audio input have a label "AUDIO" [106] corresponding to the pair. In one embodiment, a grouping of openings may have another, even more general label [108]. For example, a group of openings corresponding to a group of connectors for television input have a general label [108] which reads, "TV SOURCE IN." In one embodiment, such a grouping of openings is framed by a graphic [109] as a means of indicating that a group of connectors relate to the same device or function. The graphics [109] and labels [106] on the cover plate [100] allow a PC user to quickly and easily assess the appropriate spot to plug in a cable or connector for a device, network, power source, or other external component.

Other openings in the cover plate include mounting holes [110] corresponding to threaded holes for screws in the rear panel of the PC, or other fastening scenarios. In one embodiment, the cover plate includes an opening [111] through which a PC user can view an light emitting diode (LED) that indicates whether or not a certain activity is occurring. A label [112] on the cover plate [100], e.g., "ACTIVITY," corresponds to such an opening. Other openings in the cover plate may be desired or required, depending on the rear panel of the PC and the PCI cards which are added or removed from the PC. In one embodiment, the cover plate is removable, either by a PC user or a technician. As new PCI cards and rear panel geographies emerge, designers can develop new cover plates to account for the relocation, addition, absence, resizing or reshaping of connectors.

FIG. 2 depicts a rear view of a PC [200] equipped with a rear panel cover plate [201], in accordance with an embodiment of the present invention. In one embodiment, the cover plate [201] depicted in FIG. 2 is a single plate. In another embodiment, the cover plate [201] depicted in FIG. 2 is made up of a plurality of cover plates.

As depicted in FIG. 2, examples of connectors, ports, and devices accessed through openings in the cover plate(s) [201] are an audio input [202] and output [203], a video output [204], a television input [205], a wireless local area network (LAN) antenna [206], a coaxial [207] and optical digital audio input [208], a high speed universal service bus (USB) ports [209], a FireWire ((Institute of Electrical and Electronics Engineers (IEEE) 1394) port [210], an Ethernet port [211], a digital video output [212], a power source input [213] and an LED [215]. FIG. 2 depicts a cover plate for an "entertainment PC." Other arrangements and varieties of openings would be found on a cover plate for the rear panel of a conventional desktop PC, in accordance with an embodiment of the present invention.

As illustrated in FIG. 2, each opening in the cover plate [201] is clearly labeled in text [216] on the cover plate. Each label [216] identifies the connector, device or port which the opening [203] in the cover plate [201] is intended for. Such labeling promotes easy hook-up and disconnection of devices and cables. Some openings [209] are labeled with a symbol [217] in addition to a text label [218 and 214] on the cover plate [201]. Graphics on the cover plate [201] such as labels of extended length [218] and framing graphics [220] indicate that a group of connectors are related by device or function. For example, as illustrated in FIG. 2, a group of connectors devoted to audio output [221] are framed and labeled accordingly.

In accordance with an embodiment of the present invention, a cover plate [201] or plurality of cover plates is mounted to the rear panel of a PC [200] by inserting screws through holes in the cover plate and into threaded holes in the rear panel. It is appreciated that other means of fastening the cover plate(s) to the rear panel could be employed.

Figure 3A:
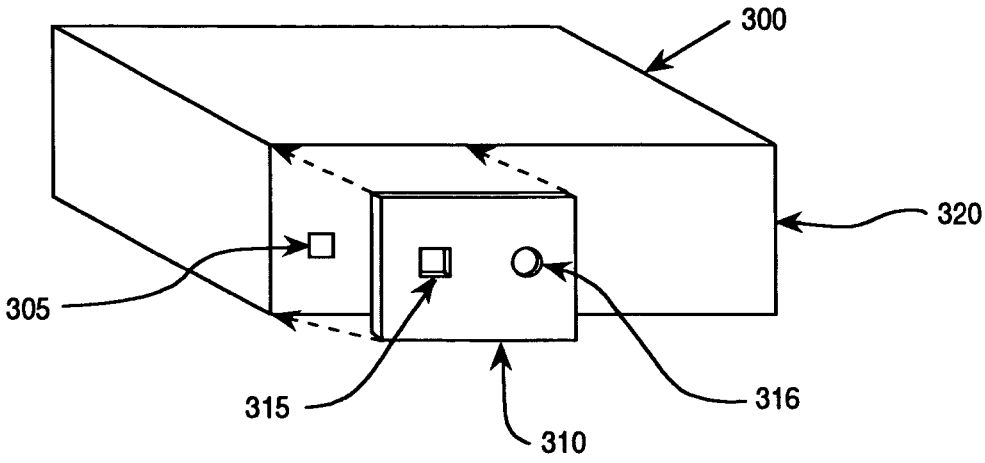
FIGS. 3A and 3B depict a PC with a removable cover plate on the rear panel according to one embodiment of the present invention.
Figure 3B:
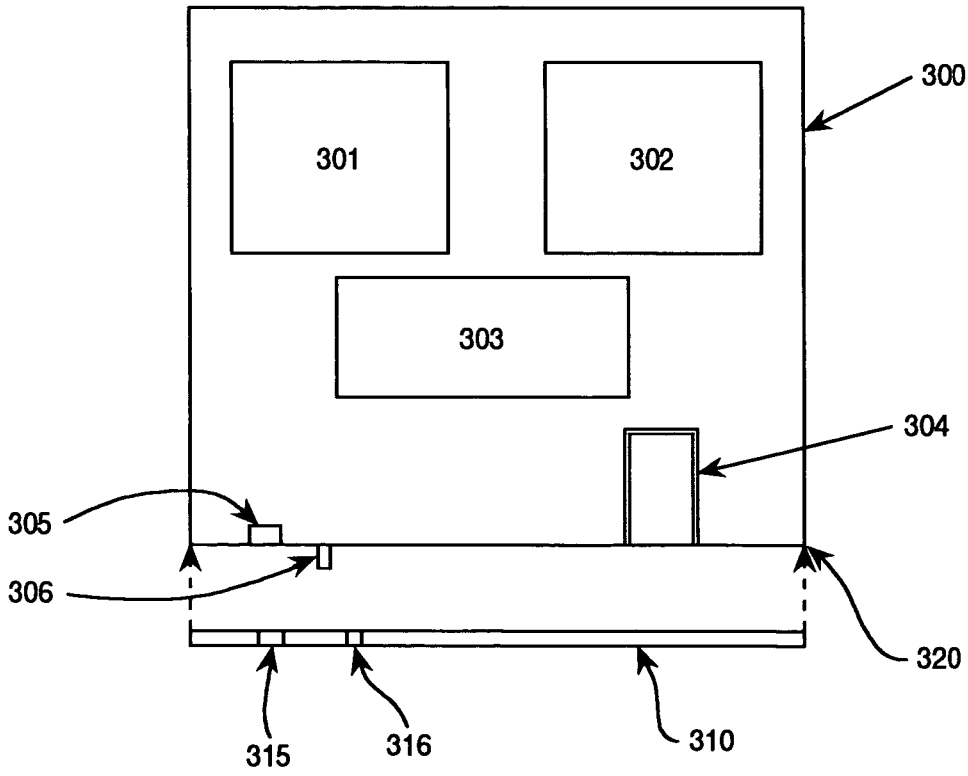

FIGS. 3A and 3B depict a PC [300] with a removable cover plate [310] on the rear panel [320]. The PC [300] as depicted in FIG. 3B includes a processor [301], a memory [302], a motherboard [303], a peripheral component interconnect (PCI) card slot [304]. The rear panel [320] for the PC [300] as depicted in FIGS. 3A and 3B includes a port [305] (e.g., a USB port, a FireWire port, or a wireless local area network (LAN) port), and a connector [306], e.g., an audio output connector. The cover plate depicted in FIGS. 3A and 3B includes an opening [315] for the port [305] on the rear panel [320] of the PC [300], as well as an opening [316] for the connector [306] on the rear panel [320] of the PC [300].

A cover plate [310] in accordance with embodiments of the present invention could also be used on the rear panel of an entertainment PC. In addition to the items listed above, an entertainment PC includes but is not limited to at least one of the following: a digital video disc (DVD) player, a television tuner, a video processor, an audio chip, and a radio signal tuner, e.g., a frequency modulation (FM) tuner. Examples of connectors found on the rear panel for an entertainment PC also include: a television source input connector, an audio input connector, an audio output connector (e.g., for a surround sound speaker system), a video input connector, a video output connector, an infrared transmitter connector, and an antenna connector. Examples of ports found on the rear panel of an entertainment PC include those found on the rear panel of a conventional PC.

A typical PC is capable of functions such as word processing, spreadsheet creation, web browsing, network connections, playing and creating music (e.g., CD's) and video (e.g. DVD's), displaying and manipulating digital photos, and playing PC games. An entertainment PC is capable of the functions of a PC as well as special entertainment functions, e.g., receiving and displaying television and radio signals, connecting to a home stereo speaker system (e.g., a surround sound system), displaying photos or videos stored on the entertainment PC on a television screen, displaying PC games on a television screen, etc.

Embodiments of the present invention are for a cover plate for the rear panel of a typical or an entertainment PC. The arrangement, sizes and shapes of openings as well as the arrangement, sizes, colors, fonts and words used in the labels may vary widely. By mounting a cover plate in accordance with an embodiment of the present invention, the rear panel of the PC is concealed from view except for connectors, etc. The cover plate provides a way for a PC user having little or no experience or knowledge of entertainment personal computers to more comfortably use his or her PC with external components, connect his or her PC to a network or power source, install an antenna on his or her PC, etc. The PC user may avoid guesswork or waiting for a computer technician's help when such a procedure is required or desired. Another advantage provided by embodiments of the present invention is a decreased chance of damage to a connector or a port, because the labeling on the cover plate is expected to reduce the likelihood that a PC user might inadvertently insert a connector into an incorrect port, etc.

The foregoing description of specific embodiments of the present invention have been presented for purposes of illustration and description. The foregoing description is not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A cover plate comprising:

a first region comprising a plurality of physical openings, each of said openings enabling access to at least one connector for connecting to an external device, said plurality of openings comprising a grouping of a subset of said openings; and a second region comprising:

a cover for a portion of a rear panel of a personal computer that houses said at least one connector;

a text label identifying at least one opening in said grouping; and a graphic that frames said grouping, wherein said plate is removably coupled with said rear panel of said personal computer.

2. The cover plate of claim 1, wherein said plate further comprises a third region comprising an opening for mounting said plate to said rear panel of said personal computer by means of a screw.

3. The cover plate of claim 1 wherein said second region further comprises an auxiliary text label identifying said grouping.

4. The cover plate of claim 1 wherein said grouping comprises openings for audio output connectors.

5. The cover plate of claim 1 wherein said grouping comprises openings for television signal reception.

6. The cover plate of claim 1 wherein said grouping comprises openings for video input connectors.

7. The cover plate of claim 1 wherein said cover plate is comprised of metal.

8. The cover plate of claim 1 wherein said cover plate is comprised of plastic.

9. The cover plate of claim 1 wherein said plurality of openings comprises an opening for a network port.

10. The cover plate of claim 1 wherein said plurality of openings comprises an opening for a television source input.

11. The cover plate of claim 1 wherein said personal computer is an entertainment personal computer comprising a component selected from the group consisting of: a digital video disc (DVD) player, a television tuner, a video processor, an audio chip, and a frequency modulation (FM) tuner.

12. The cover plate of claim 1 wherein said connector is selected from the group consisting of: a television source input, an audio input, an audio output, an infrared transmitter connector, a video input, a video output, a universal service bus (USB) port, a FireWire port, and a wireless local area network (LAN) port.

13. The cover plate of claim 1 wherein said second region further comprises a text label for each opening in said subset, wherein there is a one-to-one correspondence of text labels to openings.

14. A method of labeling openings on a panel of a personal computer, said method comprising:

attaching a first cover plate to said panel, said first cover plate comprising i) a first region comprising a plurality of physical openings, each of said openings enabling access to at least one connector, said plurality of openings comprising a grouping of a subset of said openings, and ii) a second region comprising a cover for a portion of said panel of said personal computer that houses said at least one connector, a text label identifying at least one opening in said grouping, and a graphic that frames said grouping, wherein said first cover plate is removably coupled with said panel of said personal computer; and removing said first cover plate and attaching a second cover plate in its place if a printed circuit board comprising another connector is added to said personal computer, said second cover plate comprising said first and second regions and adapted to accommodate said other connector.

15. The method of claim 14, wherein said first and second plates each comprise a third region comprising an opening for mounting said plate to said panel of said personal computer.

16. The method of claim 14 wherein said second region further comprises an auxiliary text label identifying said grouping.

17. A product comprising:

a printed circuit board for installation into a personal computer and comprising a first connector for connecting said printed circuit board to an external device; and a replacement cover plate for replacing an existing cover plate removably attached to a panel of said computer system, said existing cover plate comprising i) a first region comprising a plurality of physical openings, each of said openings enabling access to at least one connector, said plurality of openings comprising a grouping of a subset of said openings, and ii) a second region comprising a cover for a portion of said panel of said personal computer that houses said at least one connector, a text label identifying at least one opening in said grouping, and a graphic that frames said grouping; wherein further said existing cover plate is removed and replaced with said replacement cover plate in conjunction with adding said printed circuit board to said personal computer, said replacement cover plate adapted to accommodate said first connector and comprising said plurality of physical openings, said replacement cover plate also comprising a cover for a portion of said panel of said personal computer that houses said at least one connector, a text label identifying at least one opening in said grouping, and a graphic that frames said grouping.

18. The product of claim 17, wherein said first and second plates each comprise a third region comprising an opening for mounting said plate to said panel of said personal computer.

19. The product of claim 17 wherein said second region further comprises an auxiliary text label identifying said grouping.

* * * * *

UNITED STATES PATENT AND TRADEMARK OFFICE

CERTIFICATE OF CORRECTION

PATENT NO. : 7,429,191 B2
APPLICATION NO. : 11/025539
DATED : September 30, 2008
INVENTOR(S) : Elizabeth Brandon Swan Diaz et al.

It is certified that error appears in the above-identified patent and that said Letters Patent is hereby corrected as shown below:

In column 2, line 57, delete "POB" and insert -- PCB --, therefor.

Signed and Sealed this

Thirtieth Day of December, 2008

JON W. DUDAS
*Director of the United States Patent and Trademark Office*